United States Patent [19]

Dunn et al.

[11] 4,209,102

[45] Jun. 24, 1980

[54] LINERLESS PLASTIC CLOSURE

[75] Inventors: Lloyd G. Dunn, Richmond; Wilburn C. Willis, Hagerstown, both of Ind.

[73] Assignee: Aluminum Company of America, Pittsburgh, Pa.

[21] Appl. No.: 935,573

[22] Filed: Aug. 21, 1978

Related U.S. Application Data

[63] Continuation of Ser. No. 816,760, Jul. 18, 1977, abandoned.

[51] Int. Cl.[2] ..... B65D 41/28

[52] U.S. Cl. ..... 215/329; 215/341; 215/344; 215/DIG. 1; 220/288

[58] Field of Search ..... 215/344, 341, 329, 331, 215/DIG. 1; 220/288

[56] References Cited

U.S. PATENT DOCUMENTS

| | | | |
|---|---|---|---|
| 2,914,206 | 11/1959 | Lowen | 215/344 |
| 3,160,303 | 12/1964 | Healy | 215/DIG. 1 |
| 3,281,000 | 10/1966 | Lowen | 215/344 |
| 3,360,149 | 12/1967 | Roth | 215/DIG. 1 |
| 3,414,151 | 12/1968 | Morrison | 215/344 |
| 3,568,871 | 3/1971 | Livingstone | 215/344 |

*Primary Examiner*—Joseph Man-Fu Moy
*Attorney, Agent, or Firm*—David W. Brownlee

[57] ABSTRACT

A plastic closure is disclosed which has an integral sealing means formed by an annular resiliently deflectable V-shaped wall section with a downwardly and outwardly projecting corner on it for sealing against an upwardly facing sealing surface on a container. The closure also has a stop member projecting downwardly and inwardly from near the top of the closure skirt for engagement against the container mouth during application of the closure on a container to arrest the axial travel of the closure on the container. The closure may have paraffin or wax lubricant either in the plastic material of the closure or on the inside surface to reduce the torque required to seal the closure on a container.

10 Claims, 2 Drawing Figures

LINERLESS PLASTIC CLOSURE

This is a continuation of application ser. No. 816,760, filed 07/18/77, now abandoned.

BACKGROUND OF THE INVENTION

1. Field of Art

This invention is addressed to closures for sealing containers and in particular to a plastic closure having an integral sealing means therein.

2. Brief Description of the Prior Art

It is well-known to provide plastic closures having integral sealing means which obviate the need for a separate sealing liner or gasket in the closures. Elimination of a separate liner or gasket reduces the cost of closures. Linerless closures frequently have depending annular fins or ribs which seal against the container finish as disclosed in U.S. Pat. Nos. 3,224,617 and 3,844,439. Other linerless closures include deflectable diaphragm portions for sealing against the container surface as disclosed in U.S. Pat. Nos. 2,914,206; 3,160,303 and 3,414,151.

Among the disadvantages of prior art linerless plastic closures are poor sealing capabilities on rough or wavy container finishes and limited shelf life due to stress relief of the plastic during aging with resultant loss of sealing. Sealed containers should have a one-year shelf life without loss of the seal.

An improved linerless plastic closure is desired which will overcome the disadvantages of the prior art closures.

SUMMARY OF THE INVENTION

This invention provides a linerless plastic container closure having an end wall with a peripheral skirt thereafter for engagement on a container and the end wall including a resiliently deflectable V-shaped wall portion and an annular corner for sealing against a container finish. The closure further has a stop member projecting downwardly and inwardly from the closure skirt for engagement against the container mouth to arrest axial travel of the closure on the container during application. The closure may also have a lubricant in the form of paraffin or wax either compounded in the plastic or applied to the inner surface thereof for reducing the torque required to properly secure the closure on a container to commercially acceptable levels. Reducing the application torque required to overcome friction permits producing a higher compressive seal of the closure against the container and therefore results in a longer shelf life for the sealed container.

DESCRIPTION OF A PREFERRED EMBODIMENT

The plastic closure of this invention has been designed for application to standard bottle finishes. The seal is accomplished through high unit stress in the plastic at the seal area to produce a seal on rough or wavy glass. The design is such that the seal member can deflect to match the contour of uneven glass surfaces.

An added feature of this invention is that during application the center panel moves up relative to the closure skirt and thus gives a clear indication that the closure has received sufficient application torque to effect a seal.

Figure 1:
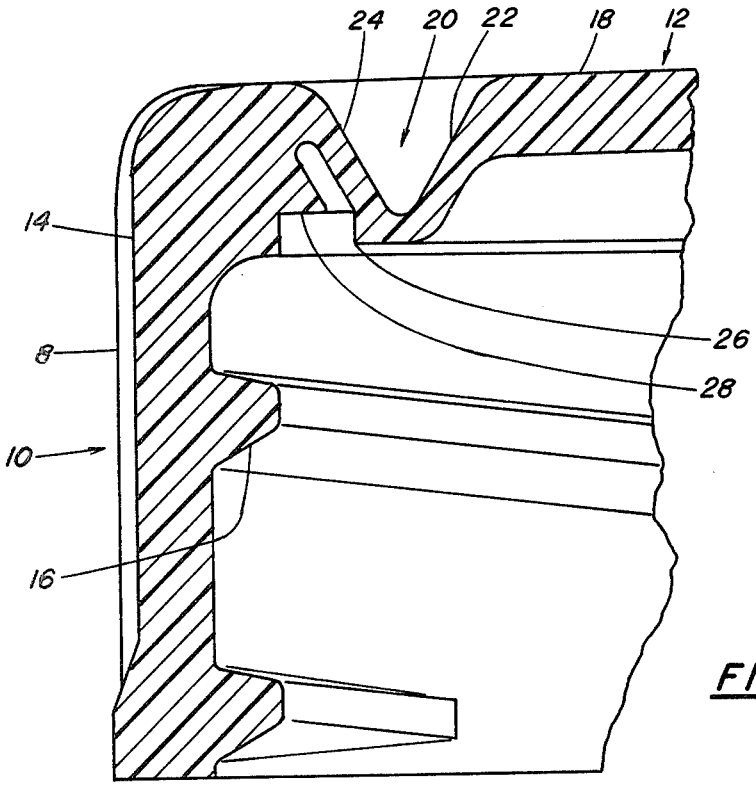
FIG. 1 is an enlarged fragmentary cross-sectional view of a closure of this invention.

As illustrated in FIG. 1, a closure 10 of this invention has a top end wall 12 and a depending skirt 14 around the end wall with threads 16 on the interior surface of the skirt for securing the closure on a container. The closure 10 may also have vertical ribs 8 on the exterior surface of the skirt 14 to form knurling for gripping the closure during application to a container or removal therefrom.

In accordance with this invention, the top end wall 12 of the closure 10 has a central wall portion 18 connected to the closure skirt 14 through a V-shaped wall section 20 which includes a first resiliently deflectable annular wall portion 22 extending downwardly and outwardly from the outer edge of the central wall portion 18 and a second resiliently deflectable wall portion 24 extending upwardly and outwardly from the bottom edge of the first wall portion. The second wall portion is connected to the top of the closure skirt 14. The V-shaped wall section further includes an annular downwardly projecting corner 26 adjacent the junction of the first and second wall sections. Such corner is adpated for sealing against an upwardly facing sealing surface on a container as will be described.

The closure 10 further has a downwardly and inwardly projecting stop member 28 on the inside surface of the skirt near the top thereof for limiting the axial travel of the closure on a container during application. Absent the stop member, a closure might be over-tightened on a container and result in improper sealing of the container as will be explained.

In a preferred embodiment of this invention, the first and second wall portions 22 and 24 are preferably thinner than is the central panel portion 18 so the first and second wall portions will be resiliently deflected during application on a container as will be described. For example, the central panel portion of a closure may be approximately 0.050 inch thick, and the first and second wall sections may be approximately 0.020 inch thick.

Closures of this invention are preferably made of plastic material such as polypropylene which has substantial structural strength while also being resiliently deflectable in the area of the first and second wall portions 22 and 24. The closure may also preferably have a lubricant such as an oleamide for reducing the torque required to seal the closure on a container.

The torque required to apply closures on containers overcomes the friction between the threads on the closure and container and at the sealing surface. If the friction forces are too high, the torque required to overcome such frictional force will prevent obtaining a high enough compressive stress between the sealing surfaces of the container and closure. Thus, lubricant introduced into the closure material will reduce the frictional forces and permit the attainment of higher compressive sealing stresses in the sealed package for a given application torque value. Paraffin or wax may also be applied on the inner surfaces of the closure threads to further reduce the frictional forces and torque required to seal the closure on its container.

Figure 2:
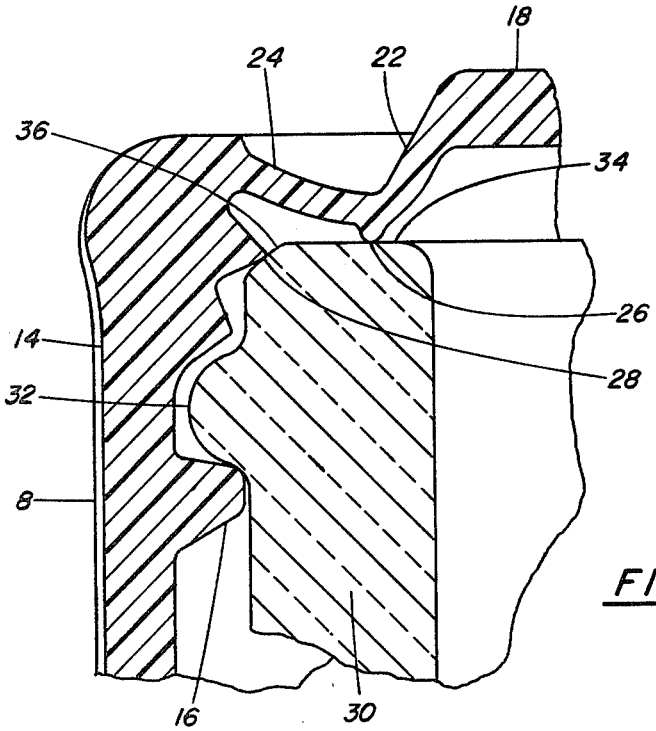
FIG. 2 is an enlarged fragmentary cross-sectional view of the closure of FIG. 1 secured on a glass container.

FIG. 2 illustrates a closure of this invention sealed on a glass container. By comparison with FIG. 1, it is seen that in the sealed closure of FIG. 2 the second wall portion 24 has been rotated and deflected upwardly into a more horizontal position with the corner 26 projecting substantially downwardly against the top sealing surface 34 on the container. To permit such deflection and rotation of the outer wall portion 24, the inner wall portion 22 has been deflected or rotated counterclockwise to a more vertical disposition and the central wall portion 18 is raised relative to the closure skirt. The upper portion of the skirt has also been radially expanded, which produces hoop tension in such upper portion. The thinner cross-sectional thickness of the first and second wall portions 22 and 24 permit their deflection and rotation during the sealing process. However, the plastic material in such wall portions has sufficient tensile strength to maintain a high pressure of the sealing corner 26 against the top sealing surface 34 of the container during prolonged storage. The hoop tension in the upper portion of the skirt also helps maintain the desired sealing pressure during storage. It is well-known that stresses in plastic material will be relieved during an aging process as for example when a sealed container is stored prior to use. It is a feature of this invention that such stress relief does not result in loss of sealing pressure between the sealing corner 26 and the container surface 34 during typical storage periods.

Another advantage of this invention is that the repatively raised position of the central wall portion 18 on the sealed container provides clear evidence that the container is properly sealed. Thus, such raised condition of the central wall portion provides a convenient check for visual inspection of the sealed containers.

The stop member 28 is important because it prevents over-travel of the closure on the container during sealing. If the closure is tightened too far on a container, the second wall portion 24 may engage the top sealing surface of the container and release or relieve the sealing pressure of corner 26 against the container sealing surface 34. If this occurs, the sealing corner 26 will not closely conform to irregularities in the glass finish as is required for a good seal. The stop member 28 prevents such over-travel of the closure on a container and insures that the sealing contact of the corner 26 against the container surface 34 is not adversely affected by such over-travel.

As stated above, lubricant in the plastic closure or on the inside surface thereof reduces the frictional force between the closure and the container and facilitates sealing the closure on a container with high unit pressure between the sealing corner 26 and the container surface. The lubricant also facilitates removal of the closure with a reasonable torque.

It is seen that this invention provides an improved linerless plastic closure having integral sealing means capable of sealing irregular and wavy surfaces on containers. Although only a single embodiment of a closure of this invention has been described, it will be apparent to those skilled in the art that modifications may be made in the closure without departing from the invention or the scope of the claims appended hereto.

What is claimed is:

1. In combination a container having a mouth opening with thread means and an upwardly facing sealing surface thereon and a linerless plastic closure comprising an end wall and a depending peripheral skirt therearound with cam means therein securing the closure on the container, said end wall having a central wall portion connected to the top of the closure skirt through a resiliently deflectable V-shaped wall section having an annular sealing corner thereon projecting downwardly from adjacent the apex of the V and sealing against said upwardly facing sealing surface on the container; said closure further having substantially rigid stop means thereon outwardly of said V-shaped wall section in abutting contact againt said container mouth to prevent overtravel of the closure on the container and avoid contact of said V-shaped wall section against said container sealing surface except by said sealing corner.

2. A linerless plastic closure adapted for sealing engagement with an associated container comprising an end wall and a depending skirt around the end wall with threads in the skirt for securing the closure on the container, said end wall having a central wall portion, a first resiliently deflectable wall portion extending downwardly from the outer edge of said central wall portion; a second resiliently deflectable wall portion extending upwardly and outwardly from the bottom edge of said first wall portion at a sharp angle to said closure skirt and connected to the top of said skirt with an acute angle between said wall portions, and an annular corner projecting downwardly from said second wall portion adjacent the junction of said first and second wall sections for sealing against an upwardly facing sealing surface on the container; said closure further including substantially rigid stop means thereon outwardly of said corner in abutting contact against the container to stop the axial travel of the closure on the container after said sealing corner has been turned downward into sealing engagement against the upwardly facing sealing surface of the container and before said second wall portion contacts such sealing surface.

3. A closure as set forth in claim 2 which has a lubricant in the plastic material of the closure.

4. A closure as set forth in claim 2 in which said resiliently deflectable wall portions have cross-sectional thicknesses approximately one-half the thickness of said central panel.

5. A closure as set forth in claim 2 in which means for limiting the axial travel of the closure comprises an integral annular stop member projecting inwardly and downwardly from near the top of the closure skirt.

6. A closure as set forth in claim 2 in which said corner is a right angle corner facing outwardly and downwardly.

7. A closure as set forth in claim 2 having vertical ribs on the exterior surface of said skirt.

8. A closure as set forth in claim 5 in which said corner is below said stop member.

9. A linerless plastic closure adapted for sealing engagement with an associated container comprising an end wall and a depending skirt around the end wall with threads in the skirt for securing the closure on the container; said end wall having a central wall portion connected to the top of the closure skirt through a V-shaped wall section formed by a first resiliently deflectable wall portion extending downwardly from the outer edge of said central wall portion; a second resiliently deflectable wall portion extending upwardly and outwardly from the bottom edge of said first wall portion at a sharp angle to the skirt with an acute angle between said wall portions, and an annular downwardly and outwardly facing corner adjacent the junction of said first and second wall sections for sealing against an upwardly facing sealing surface on the container; said closure further having a substantially rigid stop member projecting downwardly and inwardly from near the top of the closure skirt to limit the axial travel of the closure on the container and avoid contact of said second wall portion against the container sealing surface except at said annular corner which is turned downward into sealing engagement with the upwardly facing sealing surface on the container.

10. A closure as set forth in claim 9 having a lubricant in the plastic material of the closure.

* * * * *